US010069203B2

(12) United States Patent
Nair et al.

(10) Patent No.: US 10,069,203 B2
(45) Date of Patent: Sep. 4, 2018

(54) APERTURE COUPLED PATCH ANTENNA

(71) Applicant: Cambium Networks Limited, Ashburton, Devon (GB)

(72) Inventors: Deepu Nair, Kerala (IN); Nigel King, Ashburton (GB); Neeraj Kumar Maurya, Uttar Pradesh (IN)

(73) Assignee: CAMBIUM NETWORKS LIMITED, Ashburton Devon (GB)

( * ) Notice: Subject to any disclaimer, the term of this patent is extended or adjusted under 35 U.S.C. 154(b) by 0 days.

(21) Appl. No.: 15/192,132

(22) Filed: Jun. 24, 2016

(65) Prior Publication Data

US 2017/0271767 A1 Sep. 21, 2017

(30) Foreign Application Priority Data

Mar. 17, 2016 (IN) ..... 201641009266
Jun. 22, 2016 (GB) ..... 1610900.1

(51) Int. Cl.
*H01Q 1/38* (2006.01)
*H01Q 9/04* (2006.01)
*H01Q 1/48* (2006.01)

(52) U.S. Cl.
CPC ..... *H01Q 9/0407* (2013.01); *H01Q 1/48* (2013.01)

(58) Field of Classification Search
CPC ..... H01Q 1/38; H01Q 1/24; H01Q 1/48
USPC ..... 343/700 MS
See application file for complete search history.

(56) References Cited

U.S. PATENT DOCUMENTS

2003/0020655 A1* 1/2003 McKinzie, III ..... H01Q 1/38 343/700 MS
2006/0170593 A1* 8/2006 Watts ..... H01Q 9/0407 343/700 MS
2009/0224980 A1* 9/2009 Cruz ..... H01Q 1/38 343/700 MS (Continued)

FOREIGN PATENT DOCUMENTS

JP H06-97724 A 4/1994
JP H07-307614 A 11/1995

OTHER PUBLICATIONS

Aijaz et al., "Coupling Effects of Aperture Coupled Microstrip Antenna", International Journal of Engineering Trends and Technology, July to August Issue 2011, pp. 7-11.

(Continued)

*Primary Examiner* — Huedung Mancuso
(74) *Attorney, Agent, or Firm* — Brinks Gilson & Lione

(57) ABSTRACT

An aperture coupled patch antenna element comprises a ground plate having an aperture passing through the ground plate from a first side to a second opposite side. The aperture comprises a slot having an elongate cross-section, the cross-section having substantially parallel sides extending along the length of the cross-section. The antenna element also comprises a first transmission line comprising a first elongate conductor disposed on the first side of the ground plate in a substantially parallel relationship with the first side of the ground plate, and a patch radiator disposed on the second side of the ground plate in a substantially parallel relationship with the second side of the ground plate, the first transmission line being arranged to cross the slot, and the patch radiator being arranged to overlie the slot. The thickness of the ground plate at the slot is greater than the width of the slot.

10 Claims, 7 Drawing Sheets

(56) References Cited

U.S. PATENT DOCUMENTS

2010/0099367 A1* 4/2010 Sham ..... H01L 27/14659
455/95
2010/0134376 A1* 6/2010 Margomenos ..... H01P 5/028
343/848
2016/0344240 A1* 11/2016 Yeh ..... A61N 1/3787

OTHER PUBLICATIONS

Haddad et al., "Characterisation of aperture coupled microstrip patch antenna with thick ground plane", Electronics Letters, Jul. 7, 1994, vol. 30, No. 14, pp. 1106-1107.
Himdi et al., "Extension of cavity method to analyse aperture coupled microstrip patch antenna with thick ground plane", Electronics Letters, Aug. 6, 1998, vol. 34, No. 16, pp. 1534-1536.
Takeuchi et al., "A slot coupled microstrip antenna with a thick ground plane", conference paper presented at the 23rd European Microwave Conference, Oct. 1993, ATR Optical and Radio Communications Research Laboratories, Kyoto, Japan, pp. 914-916.

* cited by examiner

APERTURE COUPLED PATCH ANTENNA

RELATED APPLICATIONS

This application claims the benefit of and priority to British Patent Application No. GB 1610900.1, filed Jun. 22, 2016, and claims the benefit of and priority to Indian Patent Application No. 201641009266, filed Mar. 17, 2016, the entire contents of each of which are incorporated herein by reference.

TECHNICAL FIELD

The present invention relates generally to antennas, and more specifically, but not exclusively, to an aperture coupled patch antenna element for the transmission and/or reception of microwave frequencies in a wireless communications system.

BACKGROUND

Modern wireless communications systems place great demands on the antennas used to transmit and receive signals. Antennas may be required to produce a radiation pattern with a carefully tailored and well defined beamwidth in azimuth and elevation, while maintaining high gain characteristics and operating over a broad bandwidth. Antennas may be required to transmit and/or receive signals on one or both of two orthogonal polarisations.

A patch antenna is a type of antenna that may typically be used in a wireless communications system such as a fixed wireless access system, for example at a base station or at a user equipment terminal, such as customer premises equipment. A patch antenna typically comprises a sheet of metal known as a patch radiator, disposed in a substantially parallel relationship to a ground plane. There may be a dielectric material between the patch radiator and the ground plane, such as a typical printed circuit board substrate comprising, for example, a composite of glass fibre and resin, or there may be an air dielectric, in which case the patch radiator may be held in position in relation to the ground plane by non-conducting spacers, for example. The patch radiator may be, for example, rectangular with one side of approximately half a wavelength in length at an operating frequency of the antenna, and is typically connected to a radio transceiver by a feed track or tracks of defined characteristic impedance, typically 50 Ohms.

It is convenient to provide the feed track or tracks on one side of the ground plane and to locate the patch radiator on the other side of the ground plane. This allows the ground plane to provide a ground reference for both the patch radiator and the feed tracks, and provides shielding of radiation from the feed tracks. An aperture may be provided in the ground plane, in a so called aperture coupled patch antenna, arranged so that signals are coupled from the feed track or tracks to the patch radiator through the aperture. The ground plane is a thin conductive sheet, typically a copper layer of a printed circuit board, supported by the substrate of the printed circuit board, typically an epoxy-glass composite material. For example, aperture coupled antennas are described in the reference D. M. Pozar, "A Microstrip Antenna Aperture Coupled to a Microstrip Line", Electronics Letters, Vol. 21, pp. 49-50, Jan. 17, 1985 which describes antennas having thin ground planes formed as a copper layer of a printed circuit board having a dielectric substrate. However, the use of such a ground plane in an antenna assembly may present manufacturing difficulties and limit design options for the assembly.

It is an object of the invention to mitigate the problems of the prior art.

SUMMARY

In accordance with a first aspect of the present invention, there is provided an aperture coupled patch antenna, comprising:

a ground plate having first and second opposite sides and an aperture passing through the ground plate from the first side to the second side, the aperture comprising a slot, the slot having an elongate cross-section in the plane of the first side of the ground plate, the cross-section having substantially parallel sides extending along the length of the cross-section, and the slot having a width which is the distance between the parallel sides of the cross-section of the slot;

a first transmission line comprising a first elongate conductor disposed on the first side of the ground plate in a substantially parallel relationship with the first side of the ground plate; and a patch radiator disposed on the second side of the ground plate in a substantially parallel relationship with the second side of the ground plate, wherein the first transmission line is arranged to cross the slot, and the patch radiator is arranged to overlie the slot, and wherein the thickness of the ground plate at the slot is greater than the width of the slot.

This allows signals to be coupled from the first transmission line on one side of a ground plate to the patch radiator on the other side, and vice versa, with a low loss to radiofrequency signals, while allowing the use of a ground plate with appreciable thickness, greater than the slot width. This provides the ground plate with mechanical strength, and allows the ground plate to be manufactured by a technique, for example casting, that is economical but not suited to producing thin sheets as would be required with a conventional ground plane. The ground plate may be part of a larger assembly, such an antenna array, and may provide structural strength to the assembly. This also provides economies and eliminates design restraints caused by the provision of a printed circuit board or a conductive ground sheet requiring support. It is not obvious that an aperture through such a thick ground plate could be used to couple signals from one side to the other with low loss.

In an embodiment of the invention, the width of the slot is between 1 and 2 mm and the thickness of the ground plate is greater than 2 mm.

These dimensions provide a ground plate that is particularly robust and cheap to manufacture while providing low radio frequency loss.

In an embodiment of the invention the aperture comprises a termination cavity at each end of the slot.

This improves coupling of radio frequency signals through the aperture, giving low loss. The use of an I-shaped aperture, comprising a cross-piece across each end of the slot, provides good coupling while limiting the overall length of the aperture.

In an embodiment of the invention the slot has a length of less than half a wavelength at an operating frequency of the radio frequency transmission arrangement.

This gives a compact implementation of the radio frequency transmission arrangement with low loss.

In an embodiment of the invention the first transmission line is formed by a metallic track on a polyester film, disposed with an air gap between the polyester film and the ground plate.

This provides reduced loss in the feed network.

In an embodiment of the invention the first transmission line has an end terminated with a first termination stub.

This provides low return loss as seen by the feed network.

In an embodiment of the invention the patch radiator is formed by a metallic patch on a polyester film, disposed with an air gap between the polyester film and the ground plate.

This provides a low loss patch radiator.

In an embodiment of the invention the aperture is an air-filled cavity.

This allows a particularly low-loss connection to be established.

In an embodiment of the invention, the ground plate is composed of metal, which may be cast aluminium. This provides a ground plate with good strength. The apertures may be economically produced by moulding.

In an embodiment of the invention the ground plate is composed of a non-conductive moulding having an electrically conductive coating.

This allows the ground plate to be light weight and to be moulded in a shape to include the aperture, which may be an economical manufacturing method. The non-conductive moulding may comprises a plastic material and the conductive surface may comprise copper.

Further features and advantages of the invention will be apparent from the following description of preferred embodiments of the invention, which are given by way of example only.

DETAILED DESCRIPTION

By way of example, embodiments of the invention will now be described in the context of an aperture coupled patch antenna used as an element of an antenna array for a sector antenna for an access point of a fixed wireless access system. However, it will be understood that this is by way of example only and that other embodiments may be aperture coupled patch antennas in other wireless systems. In an embodiment of the invention, an operating frequency of approximately 5 GHz is used, but the embodiments of the invention are not restricted to this frequency, and in particular embodiments of the invention are suitable for use at lower or higher operating frequencies of up to 60 GHz or even higher.

Figure 1:
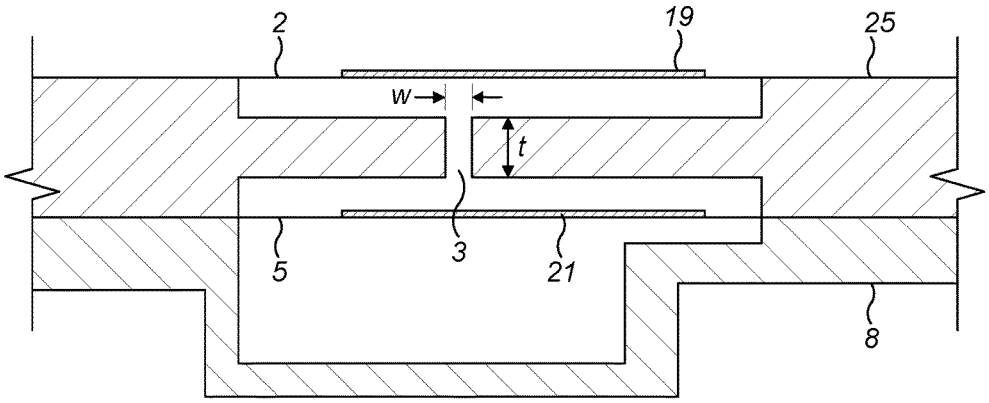
FIG. 1 is a schematic diagram showing a cross-section through an aperture coupled patch antenna element in an embodiment of the invention.

FIG. 1 is a schematic diagram showing an aperture coupled patch antenna in an embodiment of the invention, comprising a radiator element, which is in this example a patch radiator 19, which may be a conductive patch carried on a non-conductive film 2, a ground plate 25 having a aperture 3 passing between first and second opposite sides, and a feed line formed as a transmission line 21 which may be carried on a thin non-conductive film 5. A conductive cover plate 8 may be provided on the opposite side of the transmission line 21, electrically connected to the ground plate 25, to prevent radiation from the transmission line. Signals are coupled from the transmission line 21 through the aperture 3 to the patch radiator 19, for transmission. By reciprocity, signals received by the patch radiator 19 are also coupled to the transmission line 21 through the aperture 3 on reception.

Figure 2A:
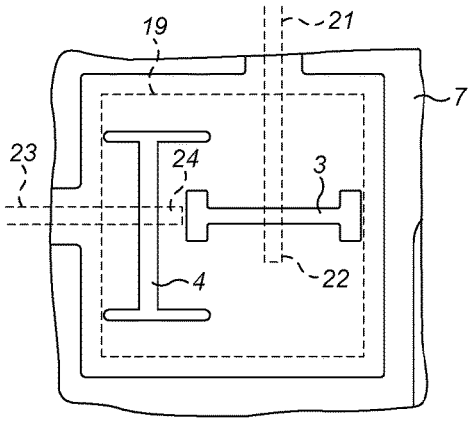
FIG. 2A shows a plan view of a dual polarised aperture coupled patch antenna element in an embodiment of the invention.

FIG. 2A shows an aperture coupled patch antenna in plan view in an embodiment of the invention. The ground plate 7 corresponds to the ground plate 25 of FIG. 1. It can be seen that the aperture 3 comprises a centre section that may be referred to as a slot, and in this embodiment has a termination cavity at each end of the slot, so that the aperture is I-shaped, having a cross-piece across each end of the slot. This provides good coupling while limiting the overall length of the aperture. It can be seen that the slot part of the aperture has an elongate cross-section in the plane of the first side of the ground plate, the cross-section having substantially parallel sides extending along the length of the cross-section. The width w of the slot is the distance between the parallel sides of the cross-section of the slot.

Conventionally, a slot may be provided in a thin ground plane. By contrast, in embodiments of the invention, as shown in FIG. 1, the thickness t of the ground plate 25 at the slot is greater than the width of the slot w. This allows signals to be coupled from the first transmission line 21 on one side of a ground plate 25 to the patch radiator 19 on the other side, and vice versa, with a low loss to radio frequency signals, while allowing the use of a ground plate with appreciable thickness, greater than the slot width. This provides the ground plate with mechanical strength, and allows the ground plate to be manufactured with by a technique, for example casting, that is economical but not suited to producing thin sheets as would be required with a conventional ground plane. The ground plate may be part of a larger assembly, such an antenna array, and may provide structural strength to the assembly. This also provides economies and eliminates design restraints caused by the provision of a printed circuit board or a conductive ground sheet requiring support. It is not obvious that an aperture through such a thick ground plate could be used to couple signals from one side to the other with low loss.

In an embodiment of the invention, the width of the slot is between 1 and 2 mm and the thickness of the ground plate is greater than 2 mm. These dimensions provide a ground plate that is particularly robust and cheap to manufacture while providing low radio frequency loss. In fact, it has been found that the slot may operate with loss even when the thickness of the ground plate is 4 times or more greater than the width of the slot.

It can be seen from FIG. 2A that the first transmission line 21 may have an end terminated with a first termination stub 22. This provides low return loss as seen by the feed network. A termination stub may be formed as various well known shapes, for example a length of track a quarter wavelength in length beyond the point where the transmission line crosses the slot.

It can also be seen from FIG. 2A that the patch radiator 19 may be substantially square, having sides approximately half a wavelength in length or less at an operating frequency of the antenna, as is well known in the art.

As shown in FIG. 2A, the aperture coupled patch antenna may comprise a second feed track comprising a second transmission line 23, which may be terminated in a second termination stub 24. Signals may be coupled from the second transmission line 23 to the patch radiator 19 through a second aperture 4, having a slot arranged at right angles to the slot of the first aperture 3, so as to couple signals to the patch radiator for radiation at an orthogonal polarisation to those coupled through the first slot. In this way, a dual polarised aperture coupled patch antenna may be formed.

Figure 2B:
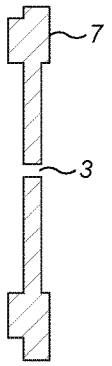
FIG. 2B shows cross-sectional view of a ground plate of a dual polarised aperture coupled patch antenna element in an embodiment of the invention.
Figure 2C:
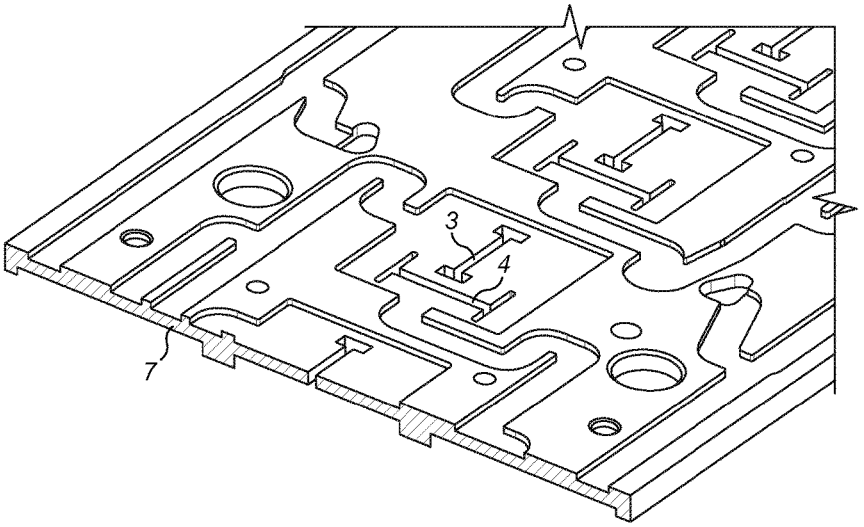
FIG. 2C shows an oblique view of a plate of an array of dual polarised aperture coupled patch antenna elements in an embodiment of the invention.

FIGS. 2B and 2C show the ground plate 7 in an embodiment of the invention in more detail. The ground plate 7 may also be referred to as the inner ground plate, as the ground plate may be composed of more than one part, including an outer ground plate (not shown in FIG. 2A, 2B or 2C).

Figure 3A:
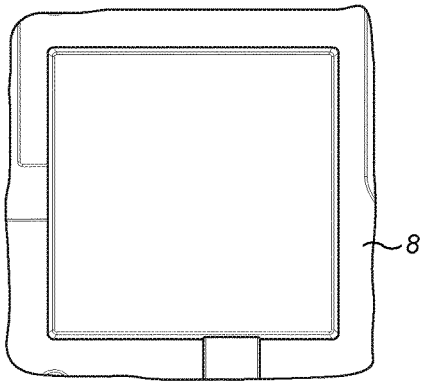
FIG. 3A is a plan view of cover plate of an aperture coupled patch antenna element in an embodiment of the invention.
Figure 3B:
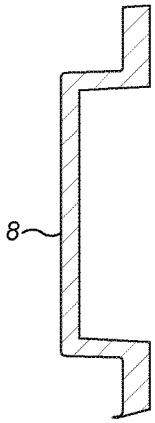
FIG. 3B is a cross-sectional view of cover plate of an aperture coupled patch antenna element in an embodiment of the invention.
Figure 3C:
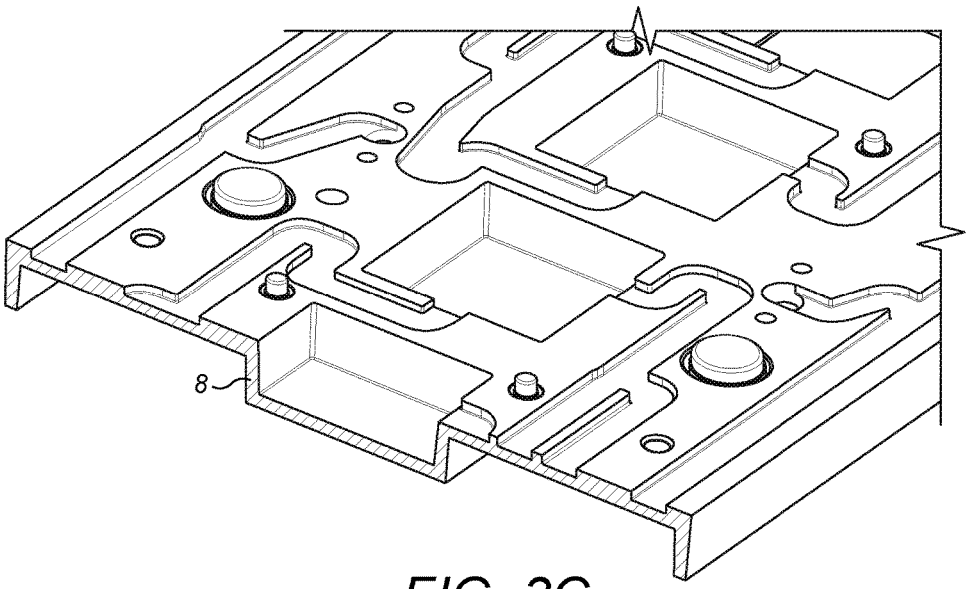
FIG. 3C is an oblique view of cover plate of an array of dual polarised aperture coupled patch antenna elements in an embodiment of the invention.

FIGS. 3A, 3B and 3C show the cover plate 8 in more detail. It can be seen from FIG. 1 and FIGS. 3B and 3C, and also by reference to FIGS. 5 and 6, that the section of the cover plate 8 underlying the apertures 3, 4 in the ground plate 25; 7 for coupling to a patch radiator 19 has a greater spacing from the feed tracks carried by film 5 than the spacing between the feed tracks carried by the film 5 and the ground plate 25; 7, typically more than 4 times the spacing. This contributes to the provision of a low loss radio frequency coupling through the slots. A section of the cover plate 8 that does not underlie the apertures 3, 4 in the ground plate for coupling to a patch radiator 19 has a substantially similar spacing from the feed tracks carried by film 5 to the spacing between the feed tracks carried by the film 5 and the ground plate. This provides a structure that provides controlled track impedance, which is relatively tolerant of displacement of the tracks due to distortion of the non-conductive film carrying the tracks.

In an embodiment of the invention the slot has a length of less than half a wavelength at an operating frequency of the radio frequency transmission arrangement, giving a compact implementation of the radio frequency transmission arrangement with low loss.

In an embodiment of the invention the first transmission line is formed by a metallic track on a polyester film, disposed with an air gap between the polyester film and the ground plate. This provides reduced loss in the feed network. In an embodiment of the invention the patch radiator is formed by a metallic patch on a polyester film, disposed with an air gap between the polyester film and the ground plate. This provides a low loss patch radiator.

In an embodiment of the invention the aperture is an air-filled cavity. This allows a particularly low-loss connection to be established. In an embodiment of the invention, the ground plate is composed of metal, which may be cast aluminium. This provides a ground plate with good strength. The apertures may be economically produced by moulding. Alternatively, the ground plate may be composed of a non-conductive moulding having an electrically conductive coating. This allows the ground plate to be light weight and to be moulded in a shape to include the aperture, which may be an economical manufacturing method. The non-conductive moulding may comprise a plastic material and the conductive surface may comprise copper.

From the foregoing description, it can be seen that a patch antenna is a type of radio antenna with a low profile, which can be mounted on a flat surface. It may consist of a flat rectangular sheet or "patch" of metal, mounted over a larger sheet of metal called a ground plane. The assembly may be contained inside a plastic radome, which protects the antenna structure from damage. The metal sheet above the ground plane may be viewed as forming a resonant piece of microstrip transmission line with a length of approximately one-half wavelength of the radio waves. The radiation mechanism may be viewed as arising from discontinuities at each truncated edge of the microstrip transmission line. The radiation at the edges may cause the antenna to act slightly larger electrically than its physical dimensions, so in order for the antenna to be resonant, a length of microstrip transmission line slightly shorter than one-half a wavelength at the frequency may be used to form the patch.

Figure 4:
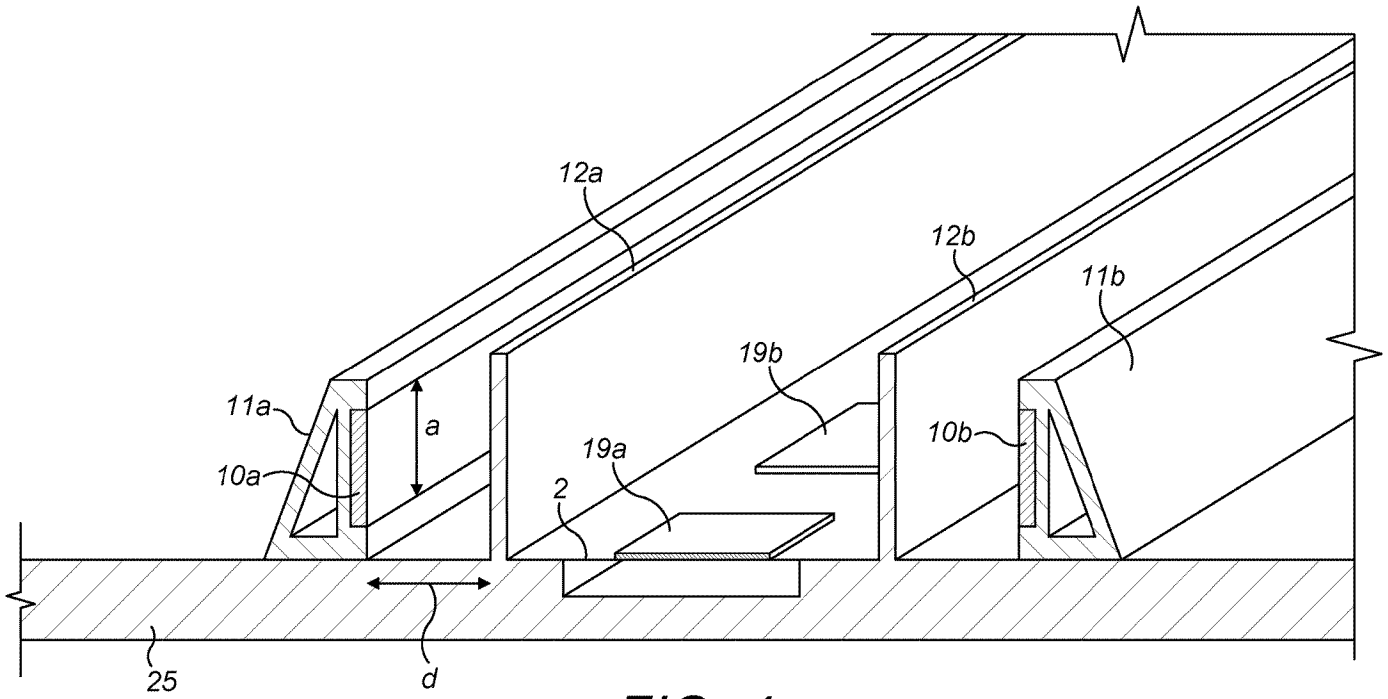
FIG. 4 is a schematic diagram showing an antenna array assembly in an embodiment of the invention.

FIG. 4 is a schematic diagram of an antenna array assembly in an embodiment of the invention. The antenna array may be an array of aperture coupled patch antenna elements according to embodiments of the invention. The antenna array assembly comprises a ground plate 25, and an array of radiator elements 19*a*, 19*b* between first and second substantially parallel conductive walls 12*a*, 12*b* projecting from the ground plate 25. A first and second conductive plate 10*a*, 10*b* is provided, each being electrically isolated from the ground plate 25, in a substantially parallel relationship with the first and second conductive walls 12*a*, 12*b*. This may provide reduced radiation in at least one direction in the hemisphere on the opposite side of the ground plate to the radiator elements. As shown in FIG. 4, the conductive plates 10*a*, 10*b* may be supported and isolated from the ground plate 25 by non-conductive brackets 11*a*, 11*b*, typically made of plastic. The radiator elements 19*a*, 19*b* may be formed from a metallic layer supported by a non-conductive film 2, such as polyester, in a spaced relationship to the ground plate 25, which may have recessed portions under the radiator elements.

Figure 5:
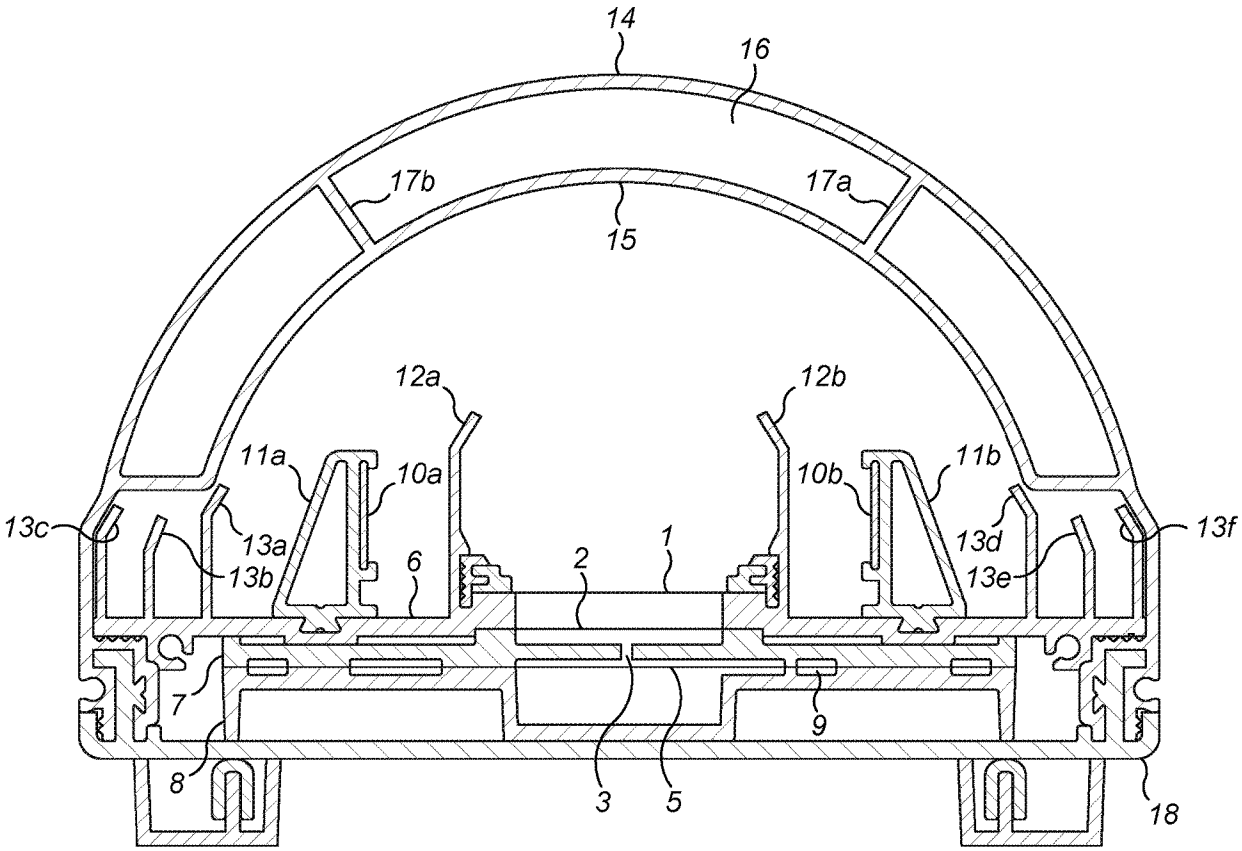
FIG. 5 is a cross-sectional view of an antenna array assembly in an embodiment of the invention.
Figure 6:
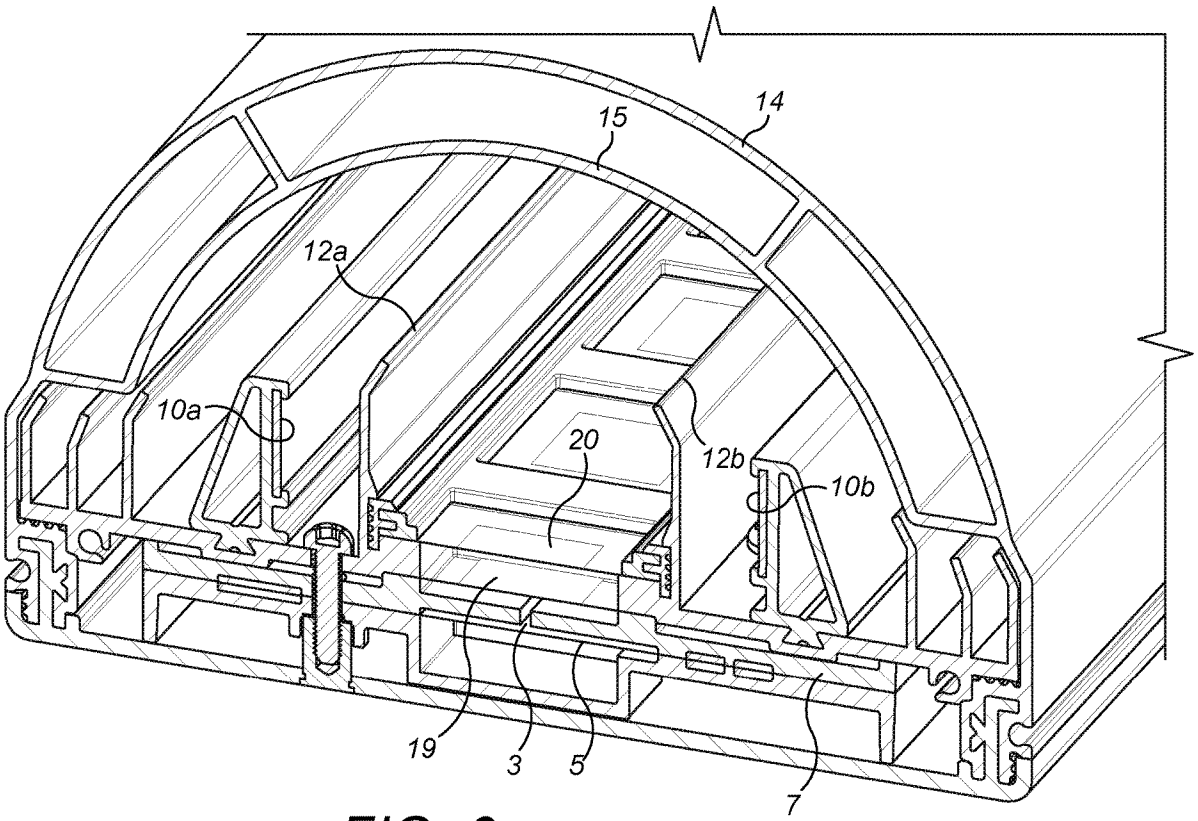
FIG. 6 is an oblique view of an antenna array assembly in an embodiment of the invention.

FIGS. 5 and 6 show a cross-sectional and oblique view respectively of an antenna array assembly in an embodiment of the invention, having corresponding features to those shown in the schematic representation of FIG. 4. The antenna array assembly comprises an array of radiator elements, in this example a linear array of patch radiator elements, one of which 19 is shown in the oblique view of FIG. 6, each of which is a rectangular conductive patch supported on a non-conductive film 2. Each patch is fed at radio frequency with a signal passing through an aperture 3 comprising a slot from a feed track printed on a non-conductive film 5 crossing below the slot. The array of radiator elements is typically fed with signals at appropriate amplitudes and phases to form a radiation beam, by a feed network which connects each feed track to a radio transceiver. In the example shown in FIGS. 5 and 6, each patch radiator element 19 is provided with a parasitic director element 20, supported on a non-conductive film 1, which may improve the broadband radiation performance of the patch radiator element. Other arrangements of radiator elements are possible, in addition to aperture coupled patch radiator elements; for example in other embodiments the radiator elements may be edge-fed patch radiator elements, or other well-known types of radiator element.

The antenna array assembly in the example shown by FIGS. 5 and 6 is provided with a ground plate corresponding to the ground plate 25 of FIG. 4, which is a conductive, typically metallic, structure. In the example of the embodiment of FIG. 5 and FIG. 6 the ground plate comprises two parts, an outer ground plate 6 and an inner ground plate 7, together forming the ground plate. A cover plate 8 is also provided. The two parts of the ground plate 6,7 and the cover plate 8 are connected together electrically, by contact and/or by metallic fixings, to form a single grounded structure, providing a radio frequency ground for the feed tracks and the radiator elements.

FIGS. 5 and 6 also show that antenna array assembly may be enclosed in a non-conductive, typically plastic enclosure. The assembly has a non-conductive bottom cover 18, and a non-conductive radome 14, 15, 17*a*, 17*b*. The radiated beam from the array of radiator elements is typically radiated away from the grounded structure 6, 7, 8 and is radiated through the radome. The non-conductive enclosure provides environmental protection for the antenna array assembly.

As may be seen from FIGS. 4, 5 and 6, the antenna array assembly has an array of radiator elements 19; 19*a*, 19*b* disposed in a spaced relationship with a first face of the ground plate 25; 6,7. In the example of FIGS. 5 and 6, the ground plate 6, 7 is formed of the outer ground plate 6 and the inner ground plate 7. The first face of the ground plate 6,7 comprises the face of the inner ground plate 7 which faces towards the patch radiator 19 and the face of the outer ground plate 6 which faces the radome 15, 16. The inner 7 and outer ground 6 plates, being connected together electrically, act as a single ground plate 6, 7.

In an embodiment of the invention, to provide reduced radiation in at least one direction in the hemisphere on the opposite side of the ground plate to the first face, that is to say to provide an improved from to back ratio for the antenna, there is provided a first and second conductive plate 10*a*, 10*b*, each being electrically isolated from the ground plate 25; 6,7 and each being disposed in an upstanding relationship to the first face of the ground plate, as can be seen from FIGS. 4, 5 and 6. The first and second conductive plates may each supported by a non-conductive support member 11*a*, 11*b* attached to the ground plate 25; 6,7. This allows the conductive plates to be held in place while maintaining electrical isolation. The non-conductive plastic support members may be made of plastic, and may conveniently be of hollow triangular cross-section as shown in FIGS. 4, 5 and 6, although other shapes are possible. Because the support members are not electrically conductive, they have little effect on the radiofrequency performance of the antenna, and so their shape is not critical. The first and second conductive plates 10*a*, 10*b* may be referred to as parasitic plates, or parasitic flanges, because they are isolated from the ground plate 25; 6,7 and so may receive and re-radiate radiation from the radiator elements. In embodiments of the invention, the reception and re-radiation of radiation by the first and second conductive plates 10*a*, 10*b*, that is to say the parasitic flanges, is arranged to cancel radiation that would tend to radiate from the back of the antenna, away from the main beam, thereby improving the front-to-back ratio of the antenna.

As shown in FIGS. 4, 5 and 6, the first and second conductive plates 10*a*, 10*b*, that is to say the parasitic flanges, may be made from a flat sheet, for example of aluminium, that extends along the length of the array of radiator elements. That is to say the conductive plates 10*a*, 10*b* are elongate, having a long side parallel to the ground plate 25; 6,7. In embodiments of the invention, the conductive plates 10*a*, 10*b* may have a width, shown as dimension "a" in FIG. 4, between 0.2 and 0.4 wavelengths at an operating frequency of the antenna array assembly. This may provide a good front-to-back ratio. A width of substantially a quarter of a wavelength may be particularly beneficial. In embodiments of the invention, the width of the conductive plates may be between 0.2 and 0.4 wavelengths at a centre frequency of the operating frequency range of the antenna. This may be, for example, 5.5 GHz.

As can be seen from FIGS. 4, 5 and 6, the array of radiator elements 19; 19*a*, 19*b* may be between first and second substantially parallel conductive walls 12*a*, 12*b* projecting from the first face of the ground plate 25; 6,7. The first and second conductive plate 10*a*, 10*b*, which are not grounded and act as parasitic flanges, may be in a substantially parallel relationship with the first and second conductive walls 12*a*, 12*b*, which are grounded, being connected to the ground plate 25; 6,7. The first and second conductive plates 10*a*, 10*b* may be outside the first and second conductive walls 12*a*, 12*b* with respect to the array of radiator elements 19.

As shown by FIG. 4, the first and second conductive plate 10*a*, 10*b*, and the first and second conductive walls 12*a*, 12*b* are typically substantially planar, and are typically substantially perpendicular to at least part of the top face of the ground plate 25, which is typically substantially planar.

In an embodiment of the invention, the first and second conductive plates are each located with a distance, shown as dimension d in FIG. 4, between 0.1 and 0.4 wavelengths from the respective conductive wall at an operating frequency of the antenna array assembly. Locating each of the first and second conductive plates substantially a quarter of a wavelength from the respective conductive wall of the first and second conductive walls may be particularly beneficial in improving the front-to-back ratio of the antenna. In an embodiment of the invention, the first and second conductive plates may each be located between 0.1 and 0.4 wavelengths from the respective conductive wall at a centre frequency of an operating frequency of the antenna array assembly.

As may be seen from FIGS. 4, 5 and 6, the first and second conductive plates 10*a*, 10*b* may be held by the non-conductive supports 11*a*, 11*b* some distance away from the ground plate 25; 6,7. In an embodiment of the invention, the first and second conductive plates 10*a*, 10*b* may be disposed at least 0.1 wavelengths away from the ground plate at an operating frequency of the antenna array assembly. This may improve the contribution of the conductive plates to front-to-back isolation.

The first and second conductive walls 12*a*, 12*b* may project from the ground plate by at least a quarter of a wavelength at an operating frequency of the antenna array assembly, which may allow the conductive walls to contribute to front-to-back isolation, in addition to improving azimuth beamwidth.

As may be seen in FIGS. 5 and 6, there may also be further grounded walls 13*a-f* projecting from the ground plate, to further improve the front-to-back ratio of the antenna. In an embodiment of the invention, the antenna array assembly comprises third and fourth conductive walls 13*a*, 13*d* projecting from the first face, in a substantially parallel relationship with the first and second conductive walls 12*a*, 12*b*, and further from the array of radiator elements 19 than are the first and second conductive plates 10*a*, 10*b*, and may comprise further conductive walls 13*b*, 13*c*, 13*e*, 13*f*, also in a substantially parallel relationship with the first and second conductive walls 12*a*, 12*b*, and further from the array of radiator elements than are the third and fourth conductive walls 13*a*, 13*d*.

In an embodiment of the invention, each conductive wall 12*a*, 12*b*, 13*a-f* may have a first substantially vertical section extending from the ground plate and a second section connected to the first section which is inclined towards the array of radiator elements. This may further improve front-to-back isolation.

In an embodiment of the invention, the ground plate and the conductive walls comprise a non-conductive material having a conductive coating. This allows the ground plate to be light weight and to be moulded in a shape to include the conductive walls, which may be an economical manufacturing method. The non-conductive moulding may comprises a plastic material and the conductive surface may comprise copper.

The example of a linear array, as shown in FIGS. 4, 5 and 6, may be particularly suited for the provision of improved front-to-back isolation by the provision of the conductive plates 10*a*, 10*b* and/or the grounded conductive walls 12*a*, 12*b*, 13*a-f*, with the long axis of the first and second conductive plates 10*a*, 10*b* being arranged parallel to the longitudinal axis of the linear array.

In an embodiment of the invention, the positions of the first and second conductive plates 10*a*, 10*b* may be transposed with the positions of the first and second conductive walls 12*a*, 12*b*. Alternatively, the first and second conductive walls 12*a*, 12*b* may be replaced by a further pair of conductive plates, isolated from the ground plate.

The front-to-back isolation may, for example, be specified as the grain difference between the forward gain measured in the main beam of a sector antenna, covering for example, a +/−45 degree sector in azimuth, and the maximum gain measured 180 degrees away from an angle in the covered sector. This may be measured at a range of elevation angles, for example from +2 degrees to −28 degrees. In an embodiment of the invention, a front-to-back isolation in excess of 34 dB for each elevation may, as an example, be achieved for each azimuth angle within the sector.

The improvement in front-to-back isolation compared with an antenna assembly that does not have the isolated conductive plates is thought to be achieved by re-radiated signals from the isolated conductive plates 10*a*, 10*b* cancelling signals from the radiator elements which are propagating towards the edges of the ground plate.

For example, it has been found that in an embodiment of the invention as illustrated by FIGS. 5 and 6, an average improvement of front-to-back isolation of 3 dB or more may be achieved for horizontally polarised radiation as compared to an antenna assembly without the isolated conductive plates 10*a*, 10*b*. Horizontal polarisation, in this example, corresponds to signals having a horizontal electric field vector, for cases where the long axis of the array is vertical.

As shown in FIGS. 5 and 6, the radome may have two non-conductive layers 14, 15, spaced apart by substantially a quarter of a wavelength at an operating frequency of the antenna assembly, at least in a part of the radome through which the beam from the antenna array may pass. Each layer is typically less than 5% of a wavelength thick. The cavity 16 between the layers may be filled with air. Spacing members 17*a*, 17*b* between the layers may be configured to be outside the region of the radome through which the main beam may pass. The material of which the radome is composed may have a relative dielectric constant of 3.2 in one embodiment. This arrangement has been found to enable transmission of the beam through the radome with low loss, and the radome has only a small effect on the radiation pattern, isolation and gain of the antenna. The spacing of the layers by substantially a quarter of a wavelength has the beneficial effect that reflections from each surface cancel each other.

The radiator elements may be patch radiator elements configured to radiate and/or receive with at least a first polarisation normal to a long axis of the first and second conductive plates. In this case, the improved front-to-back isolation may be provided in particular for the first polarisation.

Figure 7A:
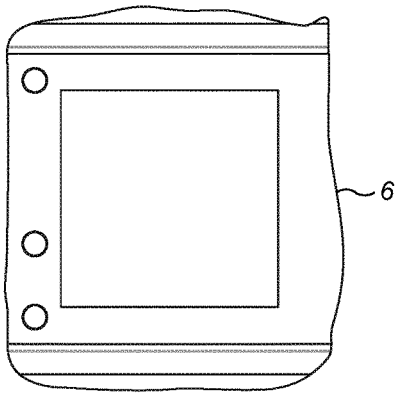
FIG. 7A is a plan view of an outer ground plate in an embodiment of the invention.
Figure 7B:
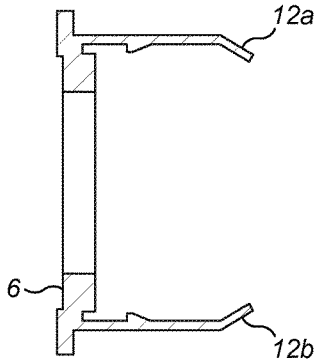
FIG. 7B is a cross-sectional view of an outer ground plate in an embodiment of the invention.
Figure 7C:
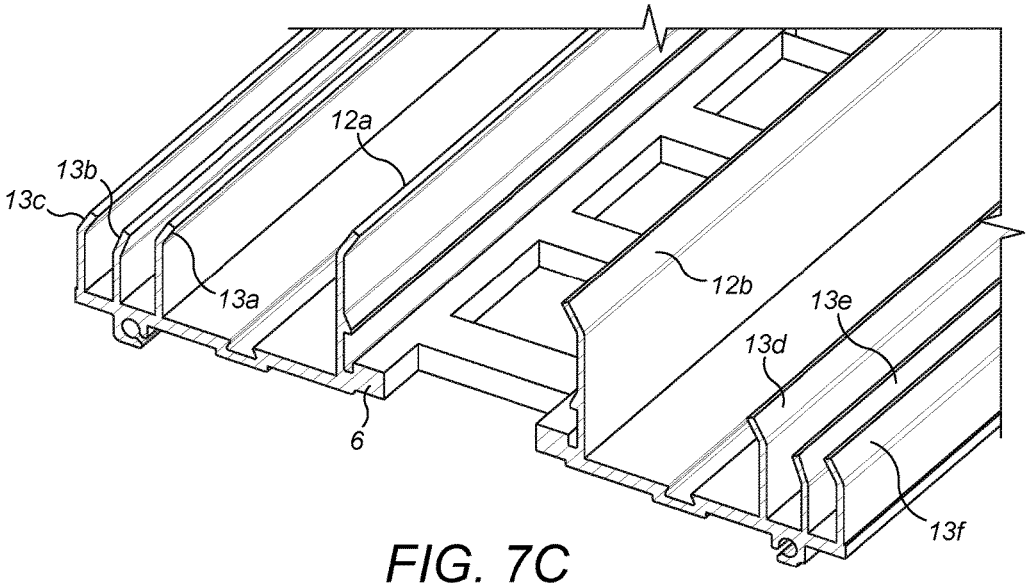
FIG. 7C is an oblique view of an outer ground plate for an array of antenna elements in an embodiment of the invention.

FIGS. 7A, 7B, and 7C show details of the outer ground plate 6 in an embodiment of the invention.

Aperture coupled patch antennas according to embodiments of the invention, for example as incorporated into an antenna array assembly as illustrated in FIGS. 5 and 6, may provide good coverage of a cellular sector. For example, an antenna intended to cover a 90 degree sector may maintain a gain relative to the peak of the main beam of −10 dB or higher over a 90 degree range in azimuth over a frequency range of 4.9 GHz to 6.1 GHz.

The above embodiments are to be understood as illustrative examples of the invention. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

What is claimed is:

1. An aperture coupled patch antenna element, comprising:

a ground plate having first and second opposite sides and an aperture passing through the ground plate from the first side to the second side, the aperture comprising a slot, the slot having an elongate cross-section in the plane of the first side of the ground plate, the cross-section having substantially parallel sides extending along the length of the cross-section, and the slot having a width which is the distance between the parallel sides of the cross-section of the slot;

a first transmission line comprising a first elongate conductor disposed on the first side of the ground plate in a substantially parallel relationship with the first side of the ground plate; and a patch radiator disposed on the second side of the ground plate in a substantially parallel relationship with the second side of the ground plate, wherein the first transmission line is arranged to cross the slot, and the patch radiator is arranged to overlie the slot, wherein the thickness of the ground plate at the slot is greater than the width of the slot, and wherein the first transmission line is formed by a metallic track on a first polyester film, disposed with a first air gap between the first polyester film and the ground plate, and the patch radiator is formed by a metallic patch on a second polyester film, disposed with a second air gap between the second polyester film and the ground plate.

2. An aperture coupled patch antenna element according to claim 1, wherein the width of the slot is less than 2 mm and the thickness of the ground plate is greater than 2 mm.

3. An aperture coupled patch antenna element according to claim 1, wherein the aperture comprises a termination cavity at each end of the slot.

4. An aperture coupled patch antenna element according to claim 1, wherein the slot has a length of less than half a wavelength at an operating frequency of the radio frequency transmission arrangement.

5. An aperture coupled patch antenna element according to claim 1, wherein the first transmission line has an end terminated with a first termination stub.

6. An aperture coupled patch antenna element according to claim 1, wherein the aperture is an air-filled cavity.

7. An aperture coupled patch antenna element according to claim 1, wherein the ground plate is composed of metal.

8. An aperture coupled patch antenna element according to claim 7, wherein the ground plate is composed of cast aluminium.

9. An aperture coupled patch antenna element according to claim 1, wherein the ground plate is composed of a non-conductive moulding having an electrically conductive coating.

10. An aperture coupled patch antenna element according to claim 9, wherein the non-conductive moulding comprises a plastic material and the conductive surface comprises copper.

* * * * *